US011203045B2

(12) United States Patent
Arkenljung et al.

(10) Patent No.: US 11,203,045 B2
(45) Date of Patent: Dec. 21, 2021

(54) METHOD AND APPARATUS FOR CLEANING PRINTING CYLINDERS

(71) Applicant: BALDWIN JIMEK AB, Arlöv (SE)

(72) Inventors: Ulf Arkenljung, Malmö (SE); Birger Hansson, Lomma (SE); Martin Maier, Uhingen (DE)

(73) Assignee: BALDWIN JIMEK AB, Arlov (SE)

( * ) Notice: Subject to any disclaimer, the term of this patent is extended or adjusted under 35 U.S.C. 154(b) by 0 days.

(21) Appl. No.: 16/484,412

(22) PCT Filed: Feb. 14, 2018

(86) PCT No.: PCT/EP2018/053719
§ 371 (c)(1),
(2) Date: Aug. 7, 2019

(87) PCT Pub. No.: WO2018/149890
PCT Pub. Date: Aug. 23, 2018

(65) Prior Publication Data

US 2019/0358680 A1 Nov. 28, 2019

(30) Foreign Application Priority Data

Feb. 15, 2017 (SE) ..... 1750145-3

(51) Int. Cl.
*B08B 1/00* (2006.01)
*B41F 35/02* (2006.01)
(Continued)

(52) U.S. Cl.
CPC ..... *B08B 1/008* (2013.01); *B41F 35/02* (2013.01); *B41F 35/04* (2013.01); *B41F 35/06* (2013.01);
(Continued)

(58) Field of Classification Search
CPC ..... B08B 1/008; B41F 35/02; B41F 35/04; B41F 35/06; B41P 2235/242; B41P 2235/246
See application file for complete search history.

(56) References Cited

U.S. PATENT DOCUMENTS 3,867,170 A * 2/1975 Ferguson ..... G03G 5/005 430/117.3
4,507,155 A * 3/1985 Cheek ..... C11D 7/5018 101/424
(Continued)

FOREIGN PATENT DOCUMENTS

CA 2039898 A1 10/1992
DE 102006039736 A1 8/2007
(Continued)

*Primary Examiner* — Sharidan Carrillo
(74) *Attorney, Agent, or Firm* — Thompson Coburn LLP

(57) ABSTRACT

A cleaning fabric wound on a roll (12) is used for cleaning printing cylinders (2, 3, 4) of a printing system (1). The cleaning fabric (13) includes a liquid absorbable material configured to be soaked with a cleaning liquid containing a polar additive configured to make the cleaning liquid polar. The roll (12) of cleaning fabric (13) is included in a cleaning cassette (10) which is movable between an idle position out of contact with the printing cylinders, and an active position in which the cleaning fabric (13) included in the cassette (10) is in contact with a printing cylinder to be cleaned.

6 Claims, 3 Drawing Sheets

(51) Int. Cl.
*B41F 35/04* (2006.01)
*B41F 35/06* (2006.01)

(52) U.S. Cl.
CPC ... *B41P 2235/242* (2013.01); *B41P 2235/246* (2013.01)

(56) References Cited

U.S. PATENT DOCUMENTS

| | | | | |
|---|---|---|---|---|
| 5,030,292 | A | 7/1991 | Koike et al. | |
| 5,368,157 | A * | 11/1994 | Gasparrini | B41F 35/00 206/209 |
| 5,974,976 | A | 11/1999 | Gasparrini et al. | |
| 6,284,720 | B1 | 9/2001 | Opre | |
| 6,432,211 | B1 * | 8/2002 | Schmitt | B41N 3/06 101/423 |
| 2006/0264350 | A1 * | 11/2006 | Howey | C11D 7/5022 510/295 |
| 2009/0101170 | A1 * | 4/2009 | Bisutti | B41F 35/04 134/6 |
| 2014/0174472 | A1 * | 6/2014 | Ardila | B08B 1/02 134/9 |
| 2015/0378263 | A1 * | 12/2015 | Stowe | B41F 35/006 355/30 |

FOREIGN PATENT DOCUMENTS

| | | | |
|---|---|---|---|
| EP | 0348609 | A2 | 1/1990 |
| EP | 2735446 | A1 | 5/2014 |
| WO | 2001083216 | A2 | 11/2001 |
| WO | 2005113243 | A1 | 12/2005 |
| WO | 2008035168 | A1 | 3/2008 |

* cited by examiner

METHOD AND APPARATUS FOR CLEANING PRINTING CYLINDERS

CROSS-REFERENCE TO RELATED APPLICATIONS

This application is a U.S. National Phase application of PCT/EP2018/053719, filed on Feb. 14, 2018, claiming the benefit of Swedish Patent Application No. 1750145-3, filed on Feb. 17, 2017, both of which are incorporated herein by reference in their entireties.

TECHNICAL FIELD

The present invention concerns fabrics for cleaning printing cylinders as well as related cleaning apparatus and methods.

BACKGROUND

To be able to have a functional printing process with printing cylinders fulfilling a desired printing result, these printing cylinders must more or less often be cleaned. Many different cleaning methods have been used in the past, for example spraying a cleaning liquid on the cylinders or cleaning the cylinders one by one by means of a type of cleaning cloth. This disclosure focus on a cleaning method using a type of cleaning fabric.

One type of cleaning fabric and cleaning method is known from U.S. Pat. No. 5,974,976 which discloses a cleaning system using a pre-soaked cleaning fabric for cleaning a printing press. The pre-soaked cleaning fabric is kept wrapped up around a core and is sealed by means of a sleeve such that the cleaning fabric may be transported and stored away without compromising its cleaning abilities until the seal is broken and the cleaning fabric shall clean the printing press. The cleaning fabric is soaked with an organic compound solvent.

Different types of solvents have been tried in order to get the desired cleaning effect, but there are problems with the compounds used today. For example, so called toning is caused when the printing cylinders, after being cleaned, start rolling and printing again. Toning is when the colour distribution on the printed surface is uneven, creating an undesired printing result. The toning will eventually even out after the printers have been in operation for a while, but the already printed material goes to waste.

WO2005/113243A1 discloses a certain type of cleaning fabric. It describes the use of a non-woven material as a cleaning fabric in combination with organic solvents as the cleaning liquid. This WO publication illustrates the need for a low-volatility cleaning liquid and the importance of the strength and abrasion resistance of the cleaning fabric. Hence, the known cleaning fabric presented therein gives no solution to the problems of toning, which can be very costly, for instance when the printers need to be cleaned more often and large amount of material has to be thrown away.

Further background art is reflected for instance in the documents CA2039898A, DE102006039736A1, EP0348609A2, EP2735446A1, U.S. Pat. Nos. 5,030,292A, 6,284,720B1 and WO2008/035168A1.

However, none of these publications presents a reliable solution to the issues with toning. Thus, there is room for improvement.

SUMMARY

An object of the present invention is to provide improvements over prior art. This object, and other objects that will appear from the following description, have now been achieved by the technique defined in the appended independent claims; certain embodiments being set forth in the related dependent claims.

In a first aspect, there is provided a roll of cleaning fabric for cleaning printing cylinders of a printing system. The cleaning fabric comprises a liquid absorbable material soaked with a cleaning liquid which comprises a polar additive containing either a glycol ether or a long-chain alcohol or both. The polar additive is configured to make the cleaning liquid polar. The cleaning fabric is wrapped or wound around a core to form the roll. An advantage with a cleaning fabric soaked with a polar cleaning liquid is that the liquid is easily dissolved in water which is beneficial during a printing process. Thus, remaining cleaning liquid from the cleaning process integrated with the water mitigate the problems with toning leading to reduced waste of prints.

Preferably, the polar additive is a compound comprising 10-16 carbon atoms. When the long-chain alcohol option is employed, it is preferred to use a 10-16 carbon atom compound. Cleaning fabrics soaked with cleaning liquid of this structure has proven to be particularly efficient. It is also preferred that the cleaning liquid comprises the polar additive in a range of 50-90 m/m %.

Depending on the circumstances under which cleaning is to take place, the cleaning fabric may be soaked with the cleaning liquid either before or after being wrapped or wound around the core for forming the roll.

In an embodiment, the roller of cleaning fabric is inserted into a removable sealing bag configured to seal around the roll in order to prevent the cleaning liquid from evaporating before use. The sealing bag secures proper operation when the cleaning fabric is to be used. The roll of cleaning fabric is preferably vacuum packed in the bag.

In a second aspect, there is provided a cleaning cassette which comprises means configured to support a roll of cleaning fabric of the type described above, and a collecting roller around which used cleaning fabric is configured to be wrapped or wound. This cassette is beneficial since it constitutes a compact and robust unit which is easy to incorporate in the printing system. Preferably, the supporting means is a rotatable shaft which is spaced from and parallel to the rotatable collecting roller.

In an embodiment, the cleaning cassette is arranged in the printing system in such a way that it is movable between an idle position in which the cleaning fabric is out of contact with any printing cylinder, and an active position in which the cleaning fabric is in contact with a printing cylinder to be cleaned. By this design, an efficient cleaning operation is achieved since the cleaning fabric is in cleaning contact only when required.

The cleaning cassette may comprise a pad configured to press the cleaning fabric against a printing cylinder to be cleaned. Hereby, a favourable press action of the cleaning fabric against the cylinder to be cleaned is achieved. The pad may be provided with an elastic element on the pad surface which is adapted to be press the cleaning fabric against the cylinder to be cleaned.

In a third aspect, there is provided a printing system comprising a cleaning cassette which is of the type described above and which preferably is movable between an idle position and a cleaning position. The printing system may comprise printing cylinders, inking rollers, damping rollers, an ink source and a damping source. Hence, this improved printing system incorporates an efficient cleaning function.

In a fourth aspect, there is provided method for cleaning printing cylinders of a printing system by means of a cleaning cassette of the design described above and including a roll of cleaning fabric as described above. The method comprises the steps of (i) unwinding from the roll at least a portion of the cleaning fabric soaked with a cleaning liquid; and (ii) placing said at least portion of the cleaning fabric in contact with a cylinder to be cleaned. This method makes it possible to clean printing cylinders in a more efficient manner than what has been possible in the art hitherto.

Preferably, used cleaning fabric is wound around the collecting roller included in the cleaning cassette which makes the cleaning procedure smooth and functional.

It is also preferred that the cleaning cassette—when cleaning is to be performed in accordance with the present cleaning method—is moved from an idle position in which the cleaning fabric is out of contact with any printing cylinders, to an active position in which the cleaning fabric is in contact with a printing cylinder to be cleaned.

In a fifth aspect, it is proposed to use a cleaning fabric for cleaning printing cylinders of a printing system, in which the cleaning fabric is soaked with a cleaning liquid which comprises a polar additive containing either a glycol ether or a long chain alcohol or both. Use of such a fabric ensures cleaning which is improved over prior art.

BRIEF DESCRIPTION OF THE DRAWINGS

Embodiments of the invention will be described in the following, reference being made to the appended diagrammatic drawings which illustrate non-limiting examples of how the inventive concept can be reduced into practice and in which.

DETAILED DESCRIPTION OF EMBODIMENTS

Figure 1:
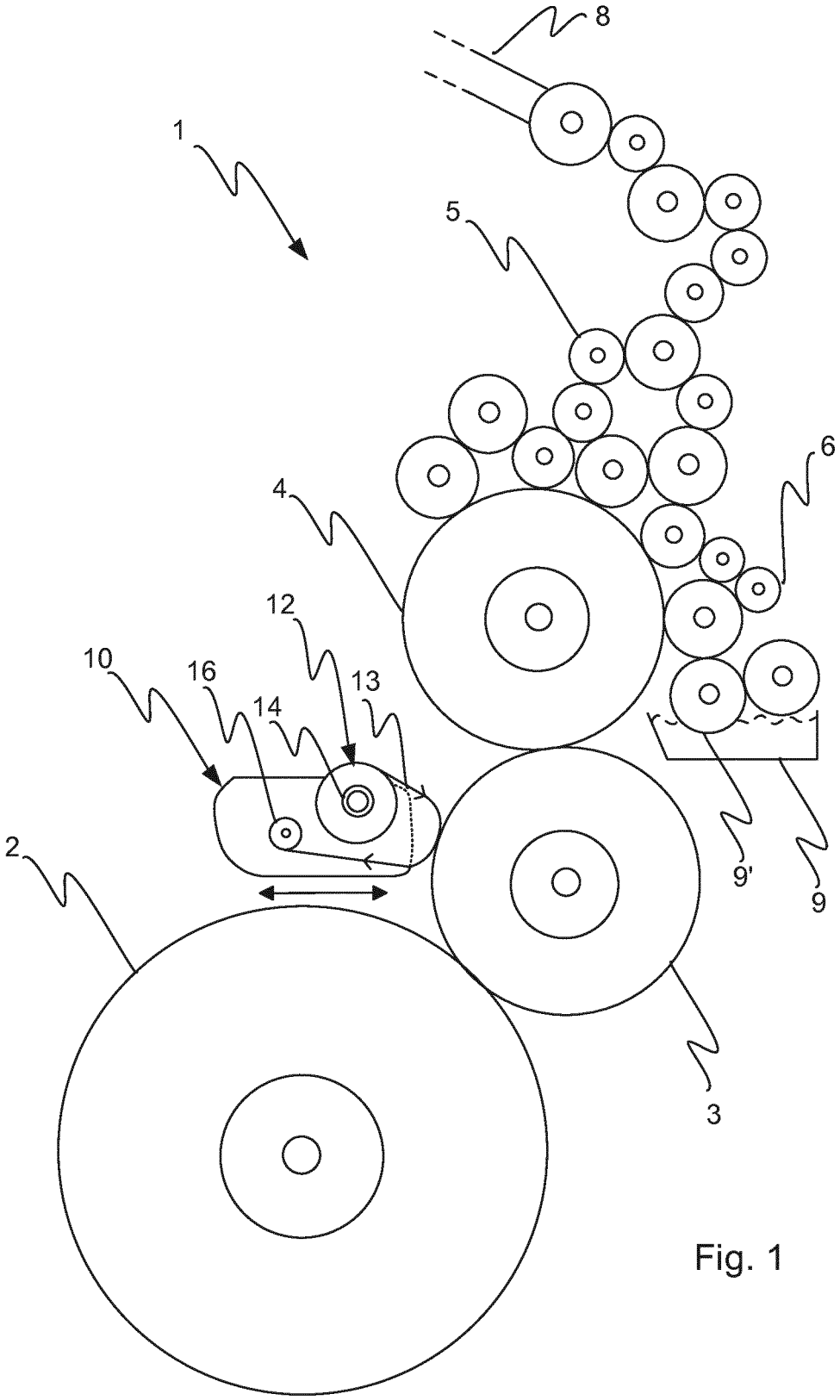
FIG. 1 shows a cross section of a general printing system with a set up of cylinders and a cleaning cassette with a cleaning fabric according to an embodiment.

With reference to FIG. 1 there is shown a general printing unit or system 1 with a number of printing cylinders and rollers 2, 3, 4, 5, 6. The printing system 1 described herein has an impression cylinder 2 (the largest printing cylinder, down to the left in FIG. 1), a blanket cylinder 3 (the medium sized cylinder next to the impression cylinder) which has a rubber sheet (not shown) and a plate cylinder 4 (the medium sized cylinder next to the blanket cylinder). The printing system 1 further has a number of inking rollers 5 (small rollers not being damping rollers) and a number of damping rollers 6 (the five small sized rollers down to the right). The set of inking rollers 5 is associated with an ink source 8 which provides the inking rollers 5 with ink. The set of damping rollers 6 is associated with a damping source, in this case a water bath 9 which provide the damping rollers 6 with water.

When the printing system 1 is performing printing work, water is firstly transported via the damping rollers 6 from the damping source 9 towards the cylinders. The water is then present at the non-pressured surfaces occurring between the cylinders 2, 3, 4. Secondly, ink is then transported by means of the ink rollers 5 from the ink source 8 towards the cylinders 3, 4, 5. The print is then transferred to the blanket cylinder 3 and the material, e.g. paper, receiving the print is arranged between the blanket cylinder 3 and the impression cylinder 2 where the printing work is conducted and the print is transferred from the rubber sheet to the material. The set up of the cylinders and rollers shown and described herein is only an example of a set up.

More or less often the printing cylinders have to be cleaned. This is made by means of a cleaning machine or cassette 10 which houses a cleaning device or roll 12 with a cleaning fabric 13, also referred to as a cleaning cloth. Before the cleaning process begins, the cleaning roll 12 is taken out of its package or bag 15 (see FIG. 4) and placed in the cleaning cassette 10.

Figure 2:
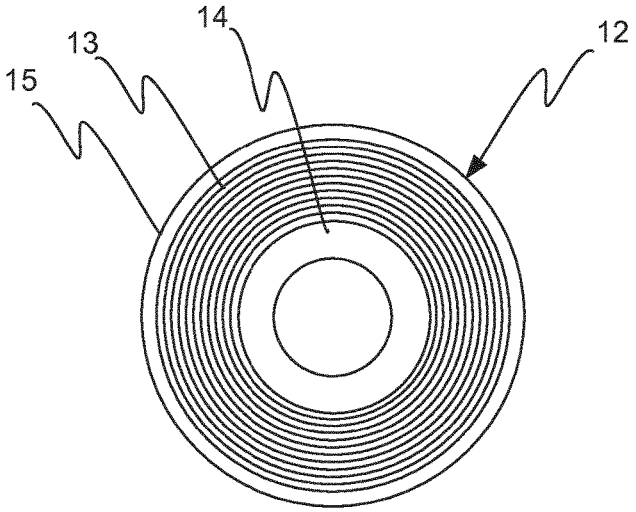
FIG. 2 shows on a larger scale a cross section of a roll of cleaning fabric before use in a cleaning process.

The cleaning roll 12 shown in FIG. 2 is pre-packed and stored until it is to be used in the cleaning process. As shown in FIGS. 1-2, the cleaning roll 12 includes a bobbin or core 14 around which the cleaning fabric 13 is wrapped or wound. The core 14 can be solid or hollow and made of any suitable material, for example plastic, paper or metal. It can also have different cross sections, and the design described herein has a circular cross section.

The cleaning fabric 13 consists of a liquid or solvent absorbable material, such as a non-woven material, which is adapted to be soaked with a cleaning liquid before starting a cleaning process. Preferably, the cleaning fabric 13 is soaked with the cleaning liquid before being packed and stored or transported, i.e. it can be soaked long before it is to be used in a cleaning process. Further, the cleaning fabric 13 can be soaked either before or after being wrapped around the core 14.

The cleaning liquid includes a polar additive or polar compound which is configured to make the cleaning liquid polar. Since liquids with similar polarity dissolve in each other, the polar additive is water soluble. By adding the polar additive to the cleaning liquid, this liquid is thus provided with a desired polar ability. This desired feature will be further explained below.

The polar additive includes glycol ether, for example butyl ether, and/or a long chain alcohol. The long chain alcohol is an alcohol with a carbon chain preferably between ten and sixteen carbon.

Further, the cleaning liquid includes the polar additive in a range of 50-90 m/m %, can also be expressed as 50-90 wt %. To clarify, the amount of polar additive in respect of the total amount of liquid is between 50-90%.

Other possible compounds of the cleaning liquid with different abilities can be aliphatic hydrocarbon for cleaning power, vegetable ester for cleaning power and reduction of evaporation, corrosion inhibitor for preventing corrosion and emulsifier for emulsification with water.

An advantage with a polar liquid is that it is water soluble, since water is also a polar liquid. A non-polar liquid is not water soluble and would instead—if brought into contact with water—gather on its surface, and form a layer on top of the water surface.

During a cleaning process of a printing system as shown in FIG. 1, the cylinders are rotated in an opposite direction with respect to the direction during a printing process. So, if a non-polar cleaning liquid is applied to the blanket cylinder 3 of FIG. 1 during a cleaning process, which is the case in known cleaning processes today, the non-polar cleaning liquid will travel from the blanket cylinder 3 to the plate cylinder 4 further onto the damping rollers 6 and down into the water bath 9. When in the water bath 9, the non-polar cleaning liquid will create a type of skin or a layer on the surface of the water. Once the printing process is restarted after the cleaning process, the cylinders and rollers will start to roll in the opposite direction compared to the direction during the cleaning process. This means that the roller/s 9' in contact with the water will not at first only transport water to the other rollers and cylinders but also the non-polar cleaning liquid.

The residue of the non-polar cleaning liquid on the printing surfaces is the reason why toning occurs on the printed paper. In order to reduce the amount of waste due to toning after a cleaning process, different types of cleaning liquids have been tried in the past with poor results. However, tests conducted by the inventors of the present patent application have surprisingly shown that if the cleaning liquid is made polar it will dissolve in the water of the water bath 9 and thus create a situation where a reduced amount of cleaning liquid is transferred back to the cylinders. In turn, this surprisingly results in reduced waste of printed paper due to toning. In order to create a polar cleaning liquid either glycol ether or long chain alcohol is used in the described embodiment. However, there may be other suitable compositions that can be used to provide the cleaning liquid with the same desired abilities; for instance both glycol ether and long-chain alcohol.

Figure 3:
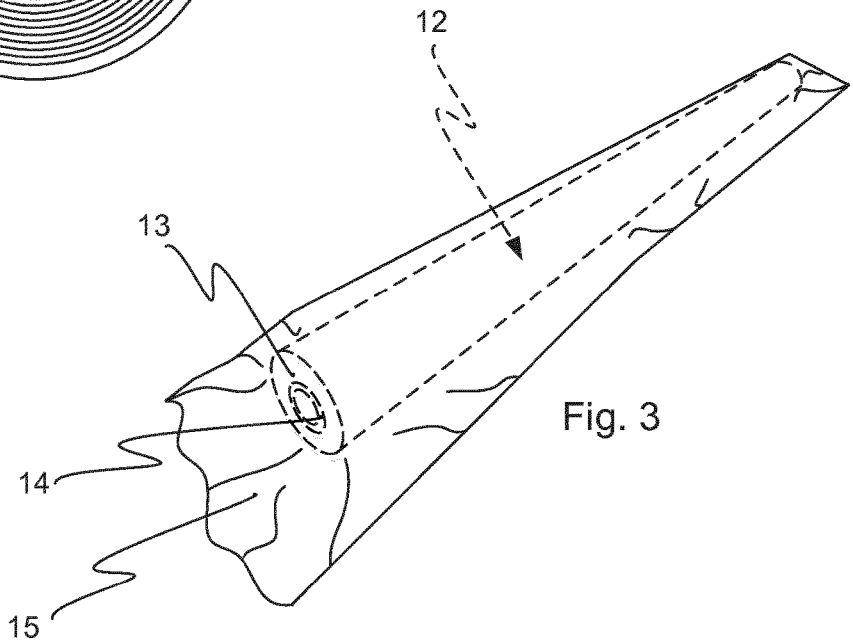
FIG. 3 illustrates the roll shown in FIG. 2 in the perspective vacuum-packed in a sealing bag.
Figure 4:
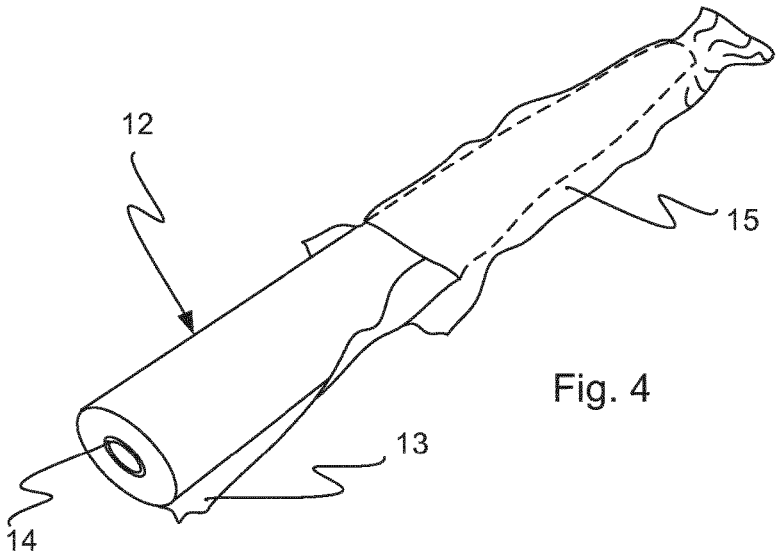
FIG. 4 illustrates the roll shown in FIG. 3 with the sealing bag partially removed.

As shown in FIGS. 2-4, the cleaning roll 12 is inserted in a removable, sealable bag 15 configured to seal around the core 14 and cleaning fabric 13 before use. Since the cleaning fabric 13 is soaked with the cleaning liquid before being stored away or transported, it is desired that the cleaning fabric 13 contains the right amount of cleaning liquid when it is about to be used in a cleaning process. The bag 15 is designed to prevent the cleaning liquid soaked in the cleaning fabric 13 from evaporating during storage or transportation of the cleaning device 12.

The cleaning roll 12 is vacuum packed until the bag 15 is broken before a cleaning process starts. Preferably, the bag 15 is tubular and built up by a multi-layer plastic film. A suitable plastic film for this purpose is a three-layer film based on a first layer of polyethylene (PE) providing a fluid barrier, a second mid layer of polyamide (PA) providing strength and a third layer of polyethylene (PE) providing a fluid barrier and a sealing layer. This three-layer plastics film has proven to be favourable in practical tests. The thickness of the sealing film is designed in such a way that it is easy to remove from the roll 12, as is shown in FIG. 4.

Figure 5:
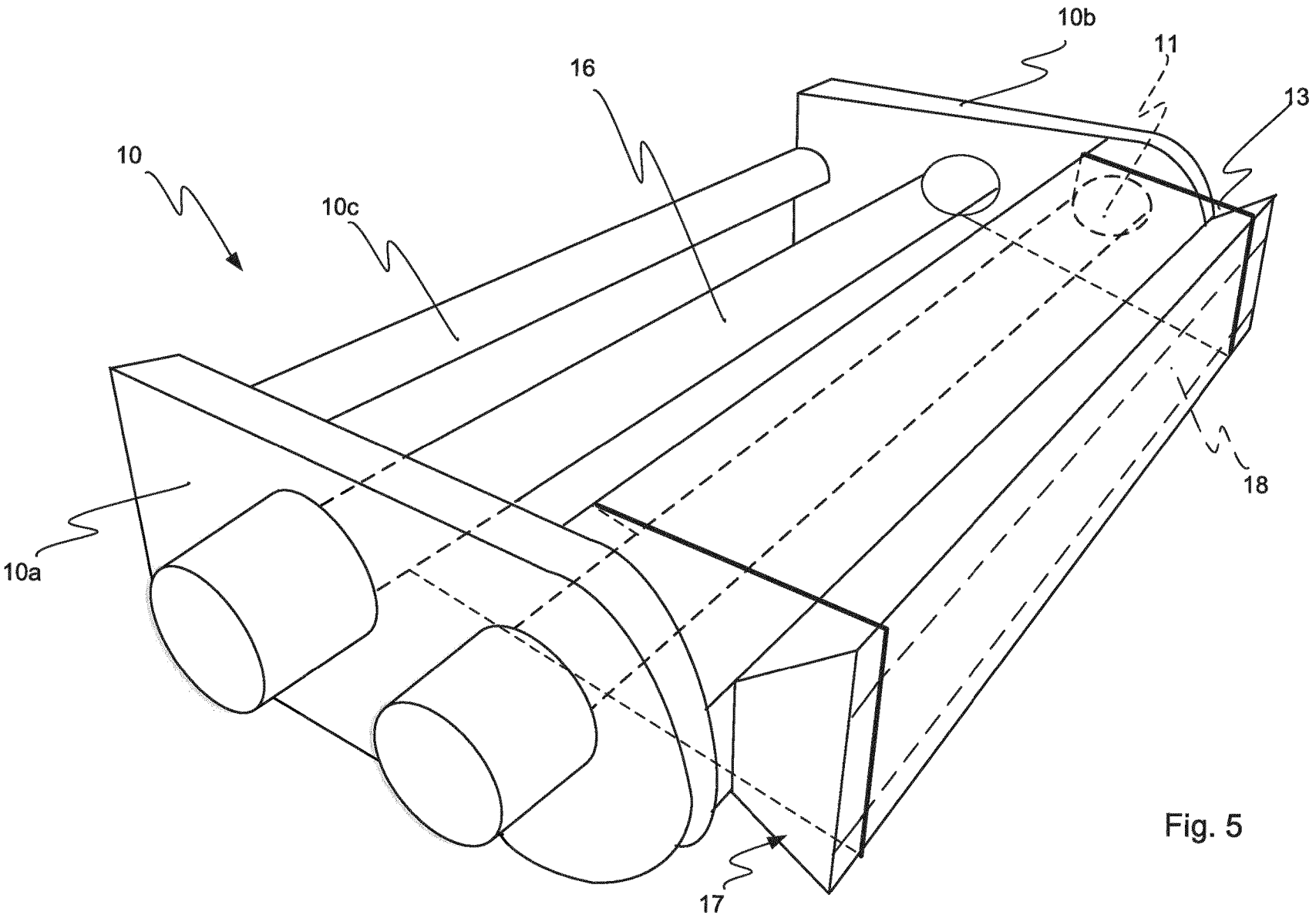
FIG. 5 illustrates on a larger scale and in the perspective the cleaning cassette included in the printing system shown in FIG. 1.

In FIG. 5, the cleaning cassette 10 included in the printing system of FIG. 1 is shown separately and in more detail. The cassette 10 includes two spaced side members 10*a* and 10*b* interconnected by a transverse member 10*c*. These members 10*a-c* form the frame of the cleaning cassette 10.

Furthermore, the cassette 10 includes mounting means in the shape of a transverse shaft 11 configured to support the core 14 of the roll 12 of cleaning fabric 13 (shown in bold in FIG. 5). The hollow core 14 has internal engagement means (not shown) configured to engage with matching engagement means (not shown) provided on the outside of the shaft 11. Hence, the shaft 11 and the roll 12 supported thereon are rotatable together. For simplifying reasons, the roll/core assembly 12/14 is not shown in FIG. 5.

At the free transverse end portion of the cassette 10, there is a front pad 17 configured to press the cleaning fabric 13 against a cylinder to be cleaned. At its front surface, the pad 17 has a transverse element 18 of elastic material, preferably rubber, which serves to press the cleaning fabric 13 against the cylinder to be cleaned with a suitable pressure. The elongate elastic element 18 protrudes somewhat from the surface of the pad 17 where it is fastened.

The cassette 10 also includes a transverse return roller or collecting roller 16 around which used cleaning fabric 13 is wrapped after been in cleaning contact with a cylinder. In this way, used cleaning fabric 13 can easily be collected and handled after a cleaning process. The shaft 11 and the collecting roller 16 are spaced apart and parallel. The collecting roller 16 is also referred to as a take-up roller since the free end of the cleaning fabric 13 is fastened to this roller before the cleaning process is initiated.

In operation, collecting roller 16 and the shaft 11 are rotated—preferably stepwise—so that fresh portions of the cleaning fabric 13 are applied to the rotating cylinder to be cleaned. This rotational movement of the cleaning fabric 13 is illustrated diagrammatically by arrows in FIG. 1. In the embodiment described herein, the collecting roller 16 is rotationally driven so that the cleaning cloth 13 is rolled off from the roll 12 supported by the rotatable shaft 11 which may have means for preventing rotation in the opposite direction (not shown).

As shown by a double arrow in FIG. 1, the cleaning cassette 10 is movable between two positions. In an idle position, the cleaning cassette 10 is kept at a distance from the cylinders and out of contact with the same. In an active position (see FIG. 1), the cleaning cassette 10 is in contact with a printing cylinder 3 to be cleaned. The printing system 1 includes means (not shown) for performing this reciprocating movement of the cleaning cassette 10 between the idle and active positions. In certain embodiments (not shown), the cleaning cassette 10 can be moved in different directions and between different positions in order to clean various cylinders included in the printing system.

Hence, the cleaning equipment is operated in accordance with a method for cleaning printing cylinders of a printing system 1 with a cleaning roll 12 including the steps of:

- unwinding at least a portion of the cleaning fabric 13, pre-soaked with the cleaning liquid, from the cleaning roll 12; and
- placing the at least a portion of the cleaning fabric 13 in contact with a cylinder to be cleaned.

Certain aspects and embodiments are recited in the following:

A cleaning fabric for cleaning printing cylinders of a printing system comprises a liquid absorbable material which is configured to be soaked with a cleaning liquid before starting the cleaning. The cleaning liquid has a polar additive, in order to make the cleaning liquid polar. An advantage with a polar cleaning liquid is that it easily mixes with water which is an important part during a printing process. Thus, remaining cleaning liquid from the cleaning process integrated with the water mitigate the problems with toning leading to reduced waste of prints.

In an embodiment the cleaning liquid comprises the polar additive in a range of 50-90 m/m %. Tests have shown that a cleaning liquid containing the polar additive within that range has a surprisingly positive effect on the result.

In another embodiment the polar additive comprises a glycol ether and/or a long chain alcohol. Also here, tests have shown that these two alternatives prove to have a surprisingly positive effect on the result.

A cleaning device for cleaning printing cylinders of a printing system comprises a cleaning fabric with a liquid absorbable material which is configured to be soaked with a cleaning liquid before starting the cleaning. The cleaning liquid comprises a polar additive in order to make the cleaning liquid polar. Further, the cleaning device has a core around which the cleaning fabric is wrapped. The described cleaning device provides a device which has the same benefits as described above.

The cleaning fabric may be soaked with the cleaning liquid either before being wrapped around the core or after being wrapped around the core. This facilitates already existing assembling processes without changing the cleaning result of the soaked cleaning fabric.

Further, the roll of cleaning fabric may be provided with a removable sealable bag configured to seal around the core and cleaning fabric in order to prevent the cleaning liquid from evaporating. By adding the sealable bag, the cleaning device can be stored away for a long time and still provide the same desired cleaning result during a cleaning process.

In order to even more improve the storing of the device, the cleaning device may be vacuum packed.

There is also provided a method for cleaning printing cylinders of a printing system with a cleaning device as described above. The method includes the steps of:

unwinding at least a portion of a cleaning fabric, soaked with a cleaning liquid, from said cleaning device; and placing said at least a portion of said cleaning fabric in contact with a cylinder to be cleaned.

Finally, although the inventive concept has been described above with reference to specific embodiments, it is not intended to be limited to the specific form set forth herein. Rather, the invention is limited only by the accompanying claims and other embodiments than the specific above are equally possible within the scope of these appended claims.

The invention claimed is:

1. A method for cleaning a printing cylinder of a printing system comprising:

providing a cleaning cassette in the printing system, the cleaning cassette comprising a roll of cleaning fabric, said cleaning fabric comprising a liquid absorbable material soaked with a cleaning liquid, wherein said cleaning liquid comprises a polar additive containing at least one of a glycol ether and a long-chain alcohol, the cleaning liquid comprising the polar additive in a range of 50 wt % to 90 wt %, the polar additive having 10 to 16 carbon atoms; wherein said polar additive is configured to make the cleaning liquid polar; wherein said cleaning fabric is wrapped around a core to form said roll, the cassette having a support adapted and configured to support the roll of the cleaning fabric, the cassette comprising a collecting roller around which used cleaning fabric is configured to be wrapped;

unwinding from said roll at least a portion of said cleaning fabric soaked with a cleaning liquid; and cleaning a print cylinder of the print system by placing said at least a portion of said cleaning fabric in contact with a print cylinder to be cleaned; and wherein the roll of cleaning fabric is soaked with the cleaning liquid before the roll is installed in the cleaning cassette.

2. The method according to claim 1, further comprising winding the used cleaning fabric around the collecting roller.

3. The method according to claim 1, wherein the step of cleaning the print cylinder includes moving said cleaning cassette from an idle position in which the cleaning fabric is out of contact with the printing cylinder, to an active position in which said cleaning fabric is in contact with the printing cylinder to be cleaned.

4. The method of claim 1 further comprising soaking the cleaning fabric with said cleaning liquid before the cleaning fabric is wrapped around said core to form the roll of the cassette.

5. The method of claim 1 further comprising soaking the roll with said cleaning liquid after the cleaning fabric is wrapped around said core.

6. The method of claim 1 further comprising removing the roll of cleaning fabric from a removable sealing bag, wherein the removable sealing bag is configured to seal around the roll of cleaning fabric in order to prevent the cleaning liquid from evaporating from the cleaning fabric before the roll of the cleaning fabric is placed in the cleaning cassette, and wherein the roll of cleaning fabric is vacuum packed until the removable sealing bag is opened to remove the roll of cleaning fabric.

* * * * *